US011719231B2

(12) United States Patent
Nahrwold et al.

(10) Patent No.: US 11,719,231 B2
(45) Date of Patent: Aug. 8, 2023

(54) METHOD FOR OPERATING A VACUUM PUMP SYSTEM

(71) Applicant: Leybold GmbH, Cologne (DE)

(72) Inventors: Matthias Nahrwold, Cologne (DE); Michael Pajonk, Hürth (DE); Dirk Schiller, Hürth (DE); Daniel Reinhard, Cologne (DE); Sebastian Walzel, Unna (DE)

(73) Assignee: LEYBOLD GMBH, Cologne (DE)

( * ) Notice: Subject to any disclaimer, the term of this patent is extended or adjusted under 35 U.S.C. 154(b) by 661 days.

(21) Appl. No.: 16/463,602

(22) PCT Filed: Nov. 10, 2017

(86) PCT No.: PCT/EP2017/078852
§ 371 (c)(1),
(2) Date: May 23, 2019

(87) PCT Pub. No.: WO2018/099710
PCT Pub. Date: Jun. 7, 2018

(65) Prior Publication Data

US 2021/0381499 A1 Dec. 9, 2021

(30) Foreign Application Priority Data

Nov. 30, 2016 (DE) ..... 10 2016 223782.9

(51) Int. Cl.
*F04B 37/14* (2006.01)
*F04B 35/04* (2006.01)
(Continued)

(52) U.S. Cl.
CPC ..... *F04B 37/14* (2013.01); *F04B 35/04* (2013.01); *F04B 49/065* (2013.01); *F04B 49/20* (2013.01);
(Continued)

(58) Field of Classification Search
CPC .. F04B 37/14; F04B 49/065; F04B 2201/021; F04B 2203/0211; F04B 2201/0604;
(Continued)

(56) References Cited

U.S. PATENT DOCUMENTS 5,383,971 A 1/1995 Selbrede
6,022,195 A * 2/2000 Gaudet ..... F04B 37/08 417/27
(Continued)

FOREIGN PATENT DOCUMENTS

CN 10359721 A 2/2014
DE 10255792 A1 6/2004
(Continued)

OTHER PUBLICATIONS

International Search Report dated Jan. 29, 2018 for PCT application No. PCT/EP2017/078852.
(Continued)

*Primary Examiner* — Bryan M Lettman
(74) *Attorney, Agent, or Firm* — Ohlandt, Greeley, Ruggiero and Perle, LLP

(57) ABSTRACT

A processing chamber is connected to a lock chamber. For evacuating the lock chamber and/or the processing chamber a vacuum pump system is provided. The latter comprises a vacuum pump equipment having at least one vacuum pump. Further, the vacuum pump system comprises a valve device for connection to the lock chamber as well as a controller. For noise reduction, a cyclically occurring operating parameter is determined by means of the controller. From said parameter it is determined at which point in time the valve is opened such that temporally before the opening of the valve the rotational speed of at least one of the vacuum pumps can be reduced. This results in a considerable noise reduction at continuing good pump-out times.

6 Claims, 3 Drawing Sheets

(51) Int. Cl.

| | |
|---|---|
| ***F04B 49/06*** | (2006.01) |
| ***F04B 49/20*** | (2006.01) |
| ***F04C 25/02*** | (2006.01) |
| ***F04C 28/08*** | (2006.01) |
| ***F04C 28/24*** | (2006.01) |

(52) U.S. Cl.
CPC ..... *F04C 25/02* (2013.01); *F04C 28/08* (2013.01); *F04C 28/24* (2013.01); *F04B 2201/021* (2013.01); *F04B 2201/0601* (2013.01); *F04B 2201/0604* (2013.01); *F04B 2203/0201* (2013.01); *F04B 2203/0209* (2013.01); *F04B 2203/0211* (2013.01)

(58) Field of Classification Search
CPC ..... F04B 2203/0209; F04B 2201/0601; F04B 35/04; F04B 49/20; F04B 2203/0201; F04C 25/02; F04C 28/08; F04C 28/24
See application file for complete search history.

(56) References Cited

U.S. PATENT DOCUMENTS

| | | | | |
|---|---|---|---|---|
| 6,185,913 | B1 | 2/2001 | Angelo et al. | |
| 6,244,825 | B1 * | 6/2001 | Sasaki | F04B 49/20 417/44.11 |
| 9,695,814 | B2 | 7/2017 | Stephens et al. | |
| 9,926,626 | B2 | 3/2018 | Stefan et al. | |
| 2003/0123990 | A1 * | 7/2003 | Yamamoto | F04C 28/08 417/44.11 |
| 2005/0031468 | A1 | 2/2005 | Kawaguchi et al. | |
| 2014/0127038 | A1 * | 5/2014 | Stephens | F04D 27/0261 417/53 |
| 2017/0305372 | A1 * | 10/2017 | Adler | B60R 16/08 |

FOREIGN PATENT DOCUMENTS

| | | | |
|---|---|---|---|
| DE | 10359270 | A1 | 9/2004 |
| DE | 102007060174 | A1 | 6/2009 |
| DE | 102013223556 | A1 | 5/2015 |
| JP | H06342760 | A | 12/1994 |
| JP | 2001500458 | A | 1/2001 |
| JP | 2002180990 | A | 6/2002 |
| JP | 2015530478 | A | 10/2015 |
| KR | 20140037217 | A | 3/2014 |

OTHER PUBLICATIONS

Summary of Reconsideration Report dated Oct. 12, 2022 for Japanese Appl. No. 2019-528620.

* cited by examiner

METHOD FOR OPERATING A VACUUM PUMP SYSTEM

BACKGROUND

1. Field of the Disclosure

The disclosure relates to a method for operating a vacuum pump system which in particular serves for evacuating a lock chamber. The lock chamber is in particular connected to a processing chamber. Likewise, the vacuum pump system can be directly connected to the processing chamber, such that no additional lock chamber is provided.

2. Discussion of the Background Art

In a processing chamber, products are in particular vacuum processed, such as coated or the like, for example. In order to be in particular able to supply the products to the processing chamber, the processing chamber is connected to a lock chamber. For evacuating the lock chamber, the latter is connected to a vacuum pump system. The vacuum pump system usually comprising a plurality of vacuum pumps in particular comprises a main pump or booster as well as a prevacuum pump. Here, in particular Roots or screw pumps are suitable as main vacuum pumps. In addition, the vacuum pump system comprises a valve device between the vacuum pump system, which in particular comprises a plurality of vacuum pumps, and the lock chamber. In addition, a controller is provided which serves in particular for controlling the at least one vacuum pump of the vacuum pump equipment. Such lock applications of vacuum pump systems require as short a pump-out time as possible. At the same time, it must be ensured that the allowable amount of mechanical and thermal stress is not exceeded. In addition, it is required that the vacuum pump system operates as silently as possible. The low noise emission is however in conflict with the required short pump-out time since the latter requires high rotational speeds of the vacuum pump equipment, wherein high rotational speeds lead to a high noise level.

It is an object of the disclosure to provide a method for operating a vacuum pump system for evacuating a chamber, in particular a lock chamber, where a noise reduction at short pump-out times can be attained.

SUMMARY

The vacuum pump system operated according to the disclosure comprises a vacuum pump equipment comprising at least one vacuum pump. Preferably, the vacuum pump equipment comprises at least two vacuum pumps which are in particular connected in series, i.e. one main vacuum pump or booster and one prevacuum pump. Here, in particular Roots pumps or screw pumps are preferred as boosters. The vacuum pump equipment is connected to a chamber, in particular a lock chamber, wherein a valve device is arranged between the vacuum pump equipment and the chamber. In addition, a controller is provided which serves in particular for operating the at least one vacuum pump, wherein, according to a particularly preferred embodiment, the controller regulates the rotational speed of the electric motor driving the at least one vacuum pump.

According to the disclosure, for noise reduction at a good pump-out performance, first at least one operating parameter is determined by the controller. This at least one operating parameter is a cyclically occurring or a cyclically changing operating parameter. A particularly suitable operating parameter is the motor current received by the electric motor driving the at least one vacuum pump, although other operating parameters are also suitable.

The cyclically occurring operating parameter or the cyclically occurring changes of the profile of the operating parameter is evaluated with the aid of the controller. Thereby it is possible to reduce the rotational speed of at least one of the vacuum pumps of the vacuum pump equipment temporally before or directly during opening of the valve device. Due to the reduced rotational speed of at least one vacuum pump of the vacuum pump equipment, in particular the main vacuum pump, a considerable noise reduction can be achieved when the valve device is opened.

Preferably, at least the rotational speed of the main vacuum pump or booster is reduced during the opening process, wherein, additionally, the rotational speed of the prevacuum pump can also be reduced. As compared with the maximum rotational speed of the pump during operation, i.e. when the lock chamber is pumped out, a reduction of at least 50%, in particular at least 80%, is achieved. Preferably, the rotational speed is reduced to 30 Hz, in particular less than 50 Hz.

Preferably, an operating parameter, which significantly changes when the valve device is opened, is used as an operating parameter. The motor current of an electric motor driving at least one vacuum pump of the vacuum pump equipment is particularly suitable for this purpose. Due to the pressure increase, the motor current strongly increases when the valve device is opened. In the course of the flow of the current it is possible in a simple manner to determine the opening of the valve device. The significant increase is in particular due to the more than fivefold, in particular tenfold, increase of the current. In particular, the significant change of the operating parameter, i.e. the signification increase of the motor current, for example, takes place within a very short period of time of in particular less than 1 to 3 seconds.

The determined profile of the motor current of an electric motor driving at least one vacuum pump is a preferred operating parameter. Alternatively or additionally, the following operating parameters or the corresponding time profile of these operating parameters can be determined and used for controlling the rotational speed of at least one vacuum pump of the vacuum pump equipment:

- inlet pressure of the vacuum pump equipment, and/or
- inlet pressure of at least one vacuum pump of the vacuum pump equipment, and/or
- temperature of a vacuum pump or another significant area of the vacuum pump system, and/or
- travelling path of a pressure relief valve between the inlet and/or the outlet side of the main vacuum pump, and/or
- travelling path of a pressure relief valve between the inlet and/or the outlet side of the prevacuum pump.

For example, with the aid of a pressure sensor the inlet pressure of the vacuum pump equipment and/or one of the vacuum pump equipments can be measured. The time profile of the pressure also allows for deducing, in simple manner, the point in time at which the valve device is opened.

Alternatively or additionally, a temporal temperature profile can be determined with the aid of a temperature sensor. Here, in particular the temperature sensor at the outlet of one of the two pumps (gas temperature) is suitable. The temperature profile, too, allows for determining the point in time for opening the valve device.

If, as a main or as a prevacuum pump, pumps are used which comprise a pressure relief valve between the inlet side and the outlet side, a travelling path of this valve, i.e. the temporal change of the valve position, can be used for determining the point in time for opening the valve device arranged between the lock chamber and the vacuum pump system.

According to a particularly preferred embodiment, a cycle length is determined on the basis of at least one operating parameter. The cycle length is the period of time between two essentially identical changes of an operating parameter. When a motor current is considered, the cycle length is thus the period of time between two significant current increases each occurring when the valve devices are opened. This is possible since during normal applications the lock chamber is cyclically opened and closed. For example, new products to be processed or to be coated are fed into the processing chamber via the lock chamber at regular intervals. According to the disclosure, this advantage of a cyclical processing and thus a cyclically occurring change of an operating parameter is used to operate the at least one vacuum pump, in particular the main vacuum pump, at a low rotational speed when the valve device is opened, and to reduce the noise emission. After the valve device has been opened, the rotational speed of the pump can be increased again such that at a reduced noise emission short pump-out cycles, i.e. a rapid reduction of the pressure in the lock chamber to the desired value, can be achieved.

In particular when several operating parameters are used, the cycle length can also be determined by evaluating several operating parameters and obtaining average values and/or a corresponding weighting with the aid of the controller, for example.

Preferably, the rotational speed of the at least one vacuum pump is at least temporally reduced, at the end of the cycle length at the latest, such that the rotational speed of the pump is reduced when the valve device is opened. Depending on the type of pump-out cycle, the rotational speed may be reduced earlier.

Further, according to a particularly preferred embodiment, the load duration is determined on the basis of at least one operating parameter. Here, the load duration is that period of time during which the lock chamber is evacuated to the defined vacuum after the valve device has been opened. For example, when the motor current is used as the operating parameter, this can be done by determining or ascertaining a reduction of the motor current to a previously defined limit value. Once the load duration has been reached during operation, the rotational speed of the at least one vacuum pump can already be reduced, even if the cycle length is not yet terminated. In particular, this offers the advantage that the period of time between the end of the load duration and the end of the cycle length can be used for reducing the rotational speed of the vacuum pump in an energy-saving manner. Hence no or only a small amount of braking is required, for example.

In a particularly preferred aspect of the disclosure, the electrical braking energy, which is generated when the rotational speeds are reduced, is stored in an energy storage or fed back to the supply network. According to the disclosure, in this preferred embodiment thus instead of the usually provided brake resistor, which is strongly heated during braking processes, an energy storage or feedback unit is employed. The stored energy can e.g. be reused for operating or accelerating the pump. Thereby, the energy efficiency of the pump equipment is considerably improved. The provision of an energy storage or feedback unit for storing or feeding back braking energy is an independent disclosure. This is independent of the cyclical operation of the pump described above. The provision of energy storage or feedback units may also be suitable for other processes, but is particularly advantageous in combination with the disclosure described above.

This independent disclosure thus relates to a vacuum pump having the conventional components such as a rotor in particular arranged in a pump housing. Depending on the pump type, a plurality of rotors or, in addition, a stator may be arranged in the housing. Further, the pump comprises a drive means, in particular in the form of an electric motor. According to the disclosure, additionally an energy storage or feedback unit is provided. The latter stores the electric energy generated during braking or feds it back into the supply network, and it can be used for driving the pump or other components. The energy storage or feedback unit is thus in particular connected to the electric motor via a frequency converter. During braking of the pump, the electric motor serves as a generator.

BRIEF DESCRIPTION OF THE DRAWINGS

Hereunder the disclosure is explained in detail on the basis of an exemplary embodiment with reference to the drawings and graphs in which.

DETAILED DESCRIPTION OF THE PREFERRED EMBODIMENT

Figure 1:
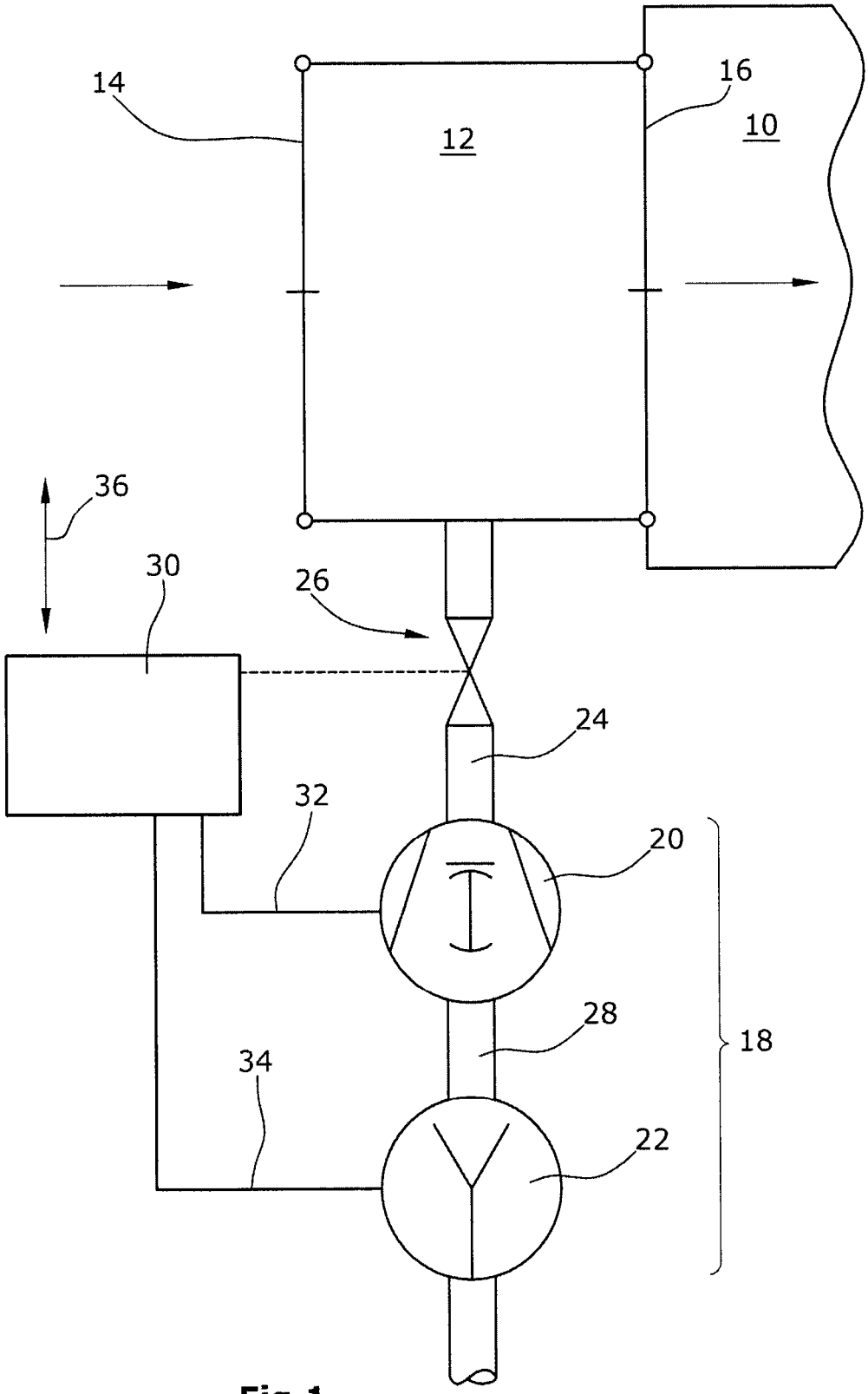
FIG. 1 shows a schematic representation of a vacuum pump system as well as a lock chamber.

In a schematically depicted processing chamber 10 a product is processed, e.g., coated. For this purpose, a vacuum is generated in the processing chamber 10. For feeding products, materials and the like to be processed into the processing chamber, a lock chamber 12 is connected to the processing chamber 10. The lock chamber 12 comprises a lock inlet 14 for feeding a product or the like into the lock chamber 12 as well as a lock outlet 16 for transferring the product or the like from the lock chamber 12 into the processing chamber 10.

For evacuating the lock chamber 12 the latter is connected to a vacuum pump system. The vacuum pump system comprises a vacuum pump equipment 18. In the illustrated exemplary embodiment, the vacuum pump equipment 18 comprises a main vacuum pump 20 and a prevacuum pump 22 arranged in series downstream of the main vacuum pump 20. The main vacuum pump 20 is in particular a Roots or screw pump. The main vacuum pump 20 is connected to the lock chamber 12 via a pipe 24, wherein in the pipe 24 a valve device 26 is arranged. The outlet of the main vacuum pump 20 is connected to the inlet of the prevacuum pump via a pipe 28.

Further, the vacuum pump system comprises a controller 30. In the illustrated exemplary embodiment, the controller 30 is connected to the main vacuum pump 20 as well as the prevacuum pump 22 via electric lines 32, 34. Via the lines 32, 34, on the one hand, an electric motor driving the corresponding pump can be controlled, and, on the other hand, operating parameters measured in or at the corresponding pump can be transmitted to the controller 30.

The measured operating parameter is in particular the motor current. Furthermore, as illustrated by an arrow 36, further data can be transmitted to the controller, and of course the controller can also perform other controlling tasks. In particular, the controller 30 can open and close the valve 26.

Hereunder the disclosure is explained with reference to FIGS. 2 and 3 on the basis of a possible evaluation of a motor current of in particular an electric motor of the main vacuum pump 20.

Figure 2:
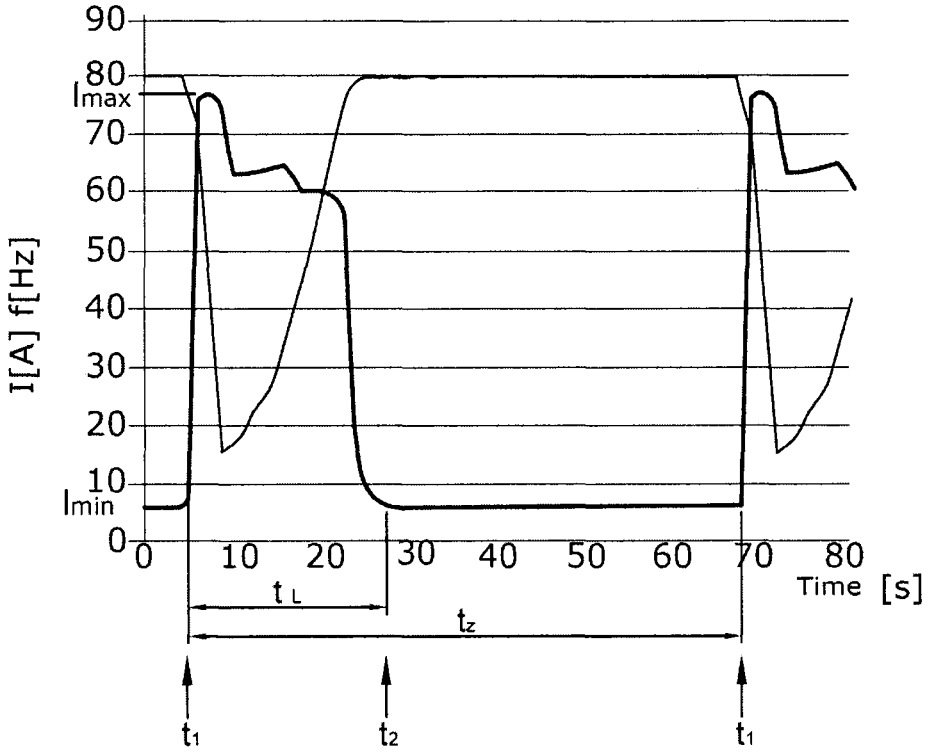
Fig.2 (PRIOR ART)
FIG. 2 shows a graph of a motor current as well as a motor rotational speed versus time in known processes.
Figure 3:
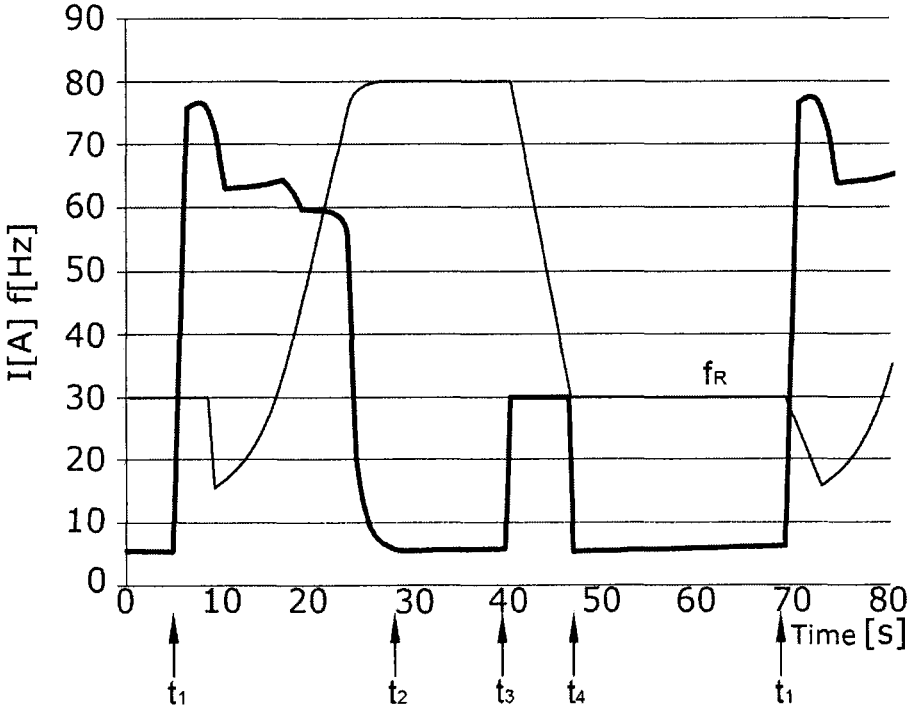
FIG. 3 shows a graph of a motor current as well as a motor rotational speed versus time in the method according to the disclosure.

Here, FIG. 2 shows a cyclical profile of a motor current as well as the rotational speed of the vacuum pump according to prior art, and FIG. 3 shows the corresponding graphs according to the disclosure.

In conventional applications, the curve of the motor current I illustrated by a thick line indicates at a point in time $t_1$, when the valve is open, a strong current increase from $I_{min}$ to $I_{max}$. The same current increase occurs again after a cycle length $t_z$ at another point in time $t_1$. From the graph or the current profile, the controller 30 can thus determine the cycle length $t_z$ on the basis of the current increase occurring in cyclical intervals at the points in time $t_1$. This determination is independent of the knowledge when the valve 26 is actually opened. This is of interest since frequently no signal is generated or issued which informs the controller that the valve is opened or when it is opened. The controller according to the disclosure is of the self-learning type since even in the case of changing processes it can automatically determine the new cycle length.

The curve of the current profile illustrated by a thick line further shows that after the current increase at the point in time $t_1$, it first decreases slowly and then relatively rapidly such that at a point in time $t_2$ the electric motor receives again the minimum current $I_{min}$.

The period of time $t_1$ to $t_2$ is the load duration, i.e. that period of time during which the lock chamber 12 is evacuated.

The further current profile after the point in time $t_2$ is then constantly at a low current $I_{min}$ until the valve is opened again at the next point in time $t_1$.

The thin line illustrates the rotational speed profile of the corresponding vacuum pump. At the point in time $t_1$, that is when the valve 26 is opened, the pressure at the pump inlet increases abruptly such that the rotational speed of the pump decreases. During the load duration $t_L$ the pump rotational speed then increases to a maximum value and remains at this maximum rotational speed until the valve is opened again at the further point in time $t_1$.

With the aid of the controller according to the disclosure it is thus possible, even without actually knowing when the valve 26 is opened, to determine a point in time for opening the valve. According to the disclosure, the rotational speed of the pump can thus be reduced before or, at the latest, when the valve 26 is opened. Thereby, considerable noise reductions can be achieved.

As illustrated in FIG. 3, the motor rotational speed is considerably reduced already before the point in time $t_1$ at which the valve 26 is opened. At a point in time $t_3$ the motor rotational speed is reduced from the maximum rotational speed, which is reached during the evacuation of the lock chamber 12, to a considerably lower rotational speed. Here, the point in time $t_3$ is later than a point in time $t_2$ such that at the point in time $t_3$ the evacuation of the lock chamber has already been performed or the load duration $t_L$ is terminated.

Preferably, again with the aid of the controller 30, a defined braking up to a point in time $t_4$ takes place. During the braking between the points in time $t_3$ and $t_4$ the current increases for a short time and decreases again to the minimum value at the point in time $t_4$.

As from the point in time $t_4$, the rotational speed of the motor is thus considerably lower than the maximum rotational speed. When the valve is opened at the subsequent point in time $t_1$, the motor does not have the maximum rotational speed as in prior art but a considerably reduced rotational speed. Hence, after the valve has been opened (point in time $t_1$) the rotational speed is further reduced only to a small extend, as can be seen in FIG. 3.

The kinetic energy released during braking between $t_3$ and $t_4$ can be fed back to the supply network via a feedback unit. Thereby, the energy efficiency of a vacuum pump can be increased which results in saving of costs at the operator's end.

Figure 4:
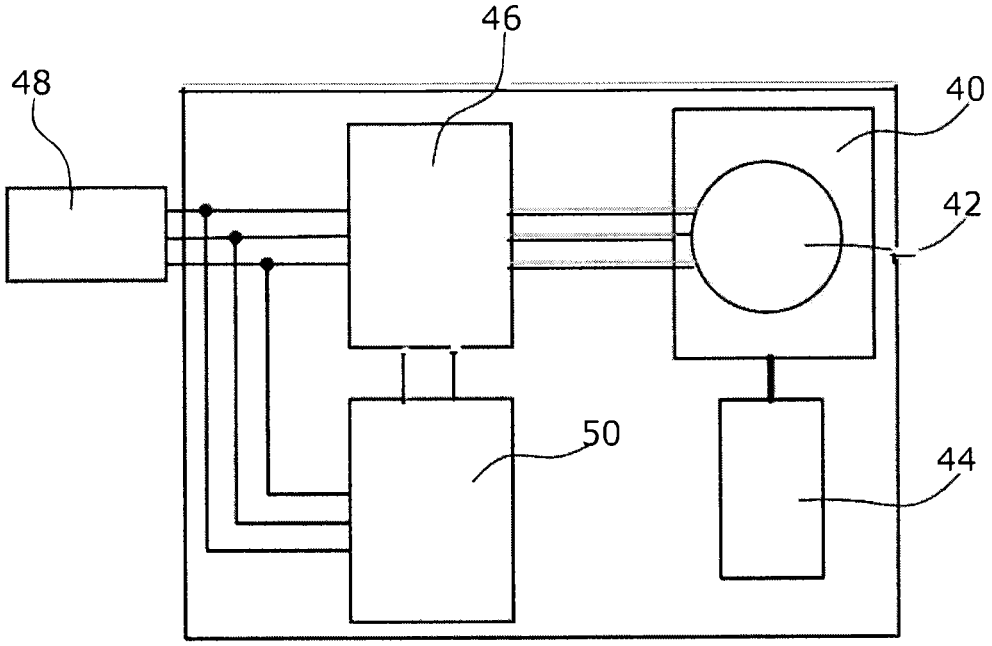
FIGS. 4 and 5 shows a schematic representation of a vacuum pump comprising an energy feedback unit.
Figure 5:
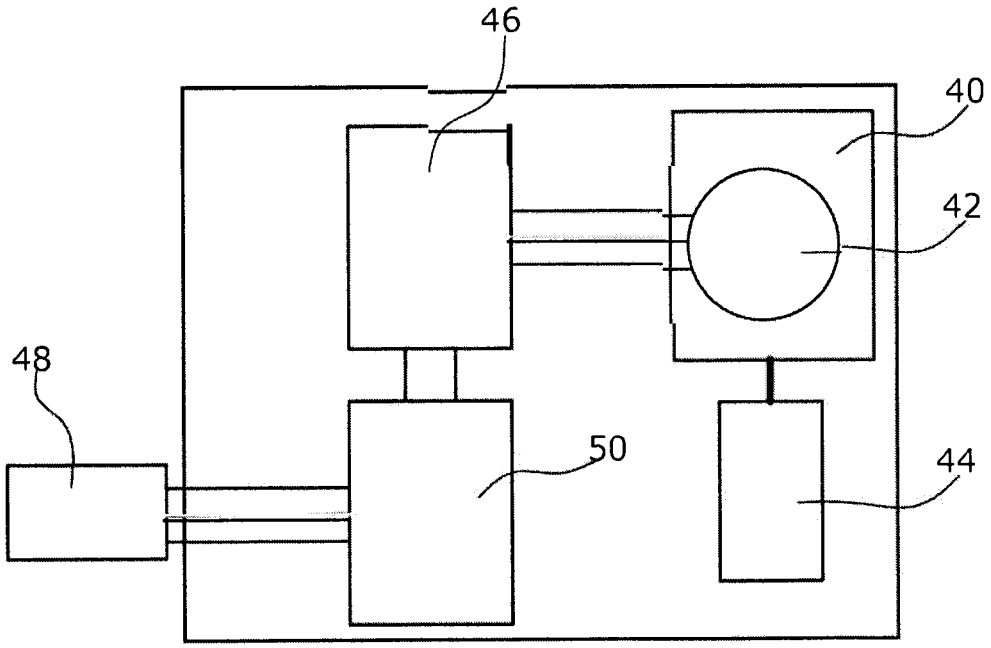

In FIGS. 4 and 5 examples of an energy feedback unit are illustrated. In a particularly preferred embodiment, these are used for pumps which are employed in the method described above. However, it is also possible to employ such energy feedback units for vacuum pumps which are used in other methods.

FIG. 4 schematically shows a vacuum pump 40 which may be the vacuum pump 20 or 22 (FIG. 1), for example. The vacuum pump 40 comprises an electric motor 42 by means of which a pump rotor 44 is driven. In the illustrated exemplary embodiment, the electric motor 42 is driven or controlled via a frequency converter 46. The frequency converter 46 is connected to the supply network 48.

When the rotor 44 of the vacuum pump 40 is braked, the electric motor 42 is used as a generator due to the considerable kinetic energy. The electrical energy produced is fed to an energy feedback unit 50 via the frequency converter and can then be fed again into the supply network 48 via the illustrated lines.

In an alternative embodiment according to FIG. 5, the connection of the frequency converter 56 to the supply network 48 via the energy feedback unit 50 is provided. The energy feedback unit 50 thus also serves as a feeding unit.

The invention claimed is:

1. A method for operating a vacuum pump system for evacuating a chamber connected to a processing chamber, wherein said vacuum pump system comprises vacuum pump equipment including at least one vacuum pump, a valve device arranged between said vacuum pump equipment and said chamber, and a controller, wherein the method comprises:

determining at least one cyclically occurring operating parameter of said vacuum pump system via said controller, and reducing temporally a rotational speed of the at least one vacuum pump of said vacuum pump equipment before said valve device is opened via said controller, wherein a cycle length is determined by said controller as a period of time between two identical changes of the at least one cyclically occurring operating parameter, such that said controller is self-learning so as to automatically determine, even in the case of changing processes, a new cycle length, wherein, on a basis of the at least one cyclically occurring operating parameter, a load duration is determined during which the chamber is evacuated to a predetermined vacuum, wherein, at a point in time after the load duration and before an end of the cycle length, the rotational speed of the at least one vacuum pump is reduced via said controller, and the rotational speed remains reduced for a remaining cycle length, and wherein between the load duration and the point in time after the load duration, the rotational speed of the at least one vacuum pump of said vacuum pump equipment is not reduced.

2. The method according to claim 1, further comprising selecting an opening of the valve device as the at least one cyclically occurring operating parameter.

3. The method according to claim 1, wherein a motor current of a motor driving the at least one vacuum pump of the vacuum pump equipment is determined as the at least one cyclically occurring operating parameter, wherein an increase of the motor current is associated with opening the valve device.

4. The method according to claim 1, wherein an inlet pressure of the vacuum pump equipment and/or an inlet pressure of the at least one vacuum pump and/or a temperature of the at least one vacuum pump and/or a travelling path of a pressure relief valve between an inlet and an outlet of the at least one vacuum pump are determined as the at least one cyclically occurring operating parameter.

5. The method according to claim 1, wherein, after the valve device has been opened, the rotational speed of the at least one vacuum pump is increased.

6. The method according to claim 1, wherein electrical braking energy generated during a reduction of the rotational speed of the at least one vacuum pump is stored in an energy storage unit or fed back into a supply network by an energy feedback unit.

* * * * *